United States Patent [19]

Walker

[11] 4,426,802

[45] Jan. 24, 1984

[54] FIREARM

[75] Inventor: Hilton R. Walker, Kloof, South Africa

[73] Assignee: Industrial Units (Proprietary) Limited, Kloof, South Africa

[21] Appl. No.: 303,680

[22] Filed: Sep. 18, 1981

[51] Int. Cl.[3] ..... F41C 1/00

[52] U.S. Cl. ..... 42/59

[58] Field of Search ..... 42/59, 5, 65, 66, 67, 42/39.5; 89/33 ME, 155

[56] References Cited

U.S. PATENT DOCUMENTS

| | | | |
|---|---|---|---|
| 1,487,722 | 3/1924 | Coenders | 42/59 |
| 2,101,148 | 12/1937 | Manville | 42/59 |
| 3,122,060 | 2/1964 | Reed | 42/59 |
| 3,145,495 | 8/1964 | Katz et al. | 42/59 |
| 4,141,165 | 2/1979 | Dichter et al. | 42/59 |

*Primary Examiner*—Charles T. Jordan

*Attorney, Agent, or Firm*—Karl W. Flocks; A. Fred Starobin; Sheridan Neimark

[57] ABSTRACT

A firearm having a frame; a barrel leading from the frame; a cartridge firing mechanism biased to an uncocked position and including a trigger and firing pin, the mechanism being operatively mounted in the frame and adapted to be operated to fire a cartridge; a rotary magazine having a plurality of circumferentially spaced cartridge chambers and being rotatable relative to the frame discretely to align the chambers with the barrel and the firing pin; a spring motor which is adapted, in use, to exert torque on the magazine relative to the frame, thereby to rotate the magazine; and indexing mechanism adapted to operate automatically after operation of the cartridge firing mechanism to allow the magazine to rotate from an aligned position in which a cartridge chamber is in alignment with the barrel and the firing pin, and to arrest the magazine in a non-aligned position in which no cartridge chamber is in alignment with the barrel and the firing pin.

16 Claims, 8 Drawing Figures

FIREARM

This invention relates to a firearm. It relates more particularly to a firearm having a spring motor driven rotary magazine.

BACKGROUND TO THE INVENTION

Firearms having rotary magazines are generally of relatively small calibre and their magazines accommodate relatively few cartridges, for example six shooter revolvers. Consequently their magazines have relatively small moments of inertia and the energy required rotationally to displace the magazines is correspondingly little. Therefore, such small calibre limited capacity magazines can generally be rotated effectively by making use of trigger pull to provide the necessary energy.

However, with larger magazines having larger moments of inertia due to a relatively large calibre or a relatively large capacity or both, the trigger pull required to displace them becomes correspondingly larger which is not conducive to ease of operation and accuracy in shooting.

Another problem with such large or heavy magazines is that when the magazine is rotated and arrested in its aligned position immediately prior to firing, the momentum of the magazine is transferred to the frame of the firearm. This causes the firearm to jerk, thus hindering aiming and steadying of the firearm. If the magazine is rotated to an aligned position immediately after firing before the firearm is cocked to fire a succeeding cartridge, a potentially dangerous situation develops, as the cartridge can be fired unintentionally, for example if the firearm is dropped.

Furthermore, the mounting of such larger magazines to the frames of their firearms becomes more difficult, especially if they are to be readily detachable from their frames.

It is an object of the present invention to alleviate at least some of the above problems.

SUMMARY OF THE INVENTION

In accordance with the invention, there is provided a fire arm comprising a frame;

a barrel leading from the frame;

a cartridge firing mechanism biassed to an uncocked position and including a trigger and firing pin, the mechanism being operatively mounted in the frame and adapted to be operated to fire a cartridge;

a rotary magazine having a plurality of circumferentially spaced cartridge chambers and being rotatable relative to the frame discretely to align the chambers with the barrel and the firing pin;

a spring motor which is adapted, in use, to exert torque on the magazine relative to the frame, thereby to rotate the magazine; and indexing means adapted to operate automatically after operation of the cartridge firing mechanism to allow the magazine to rotate from an aligned position in which a cartridge chamber is in alignment with the barrel and the firing pin, and to arrest the magazine in a non-aligned position in which no cartridge chamber is in alignment with the barrel and the firing pin.

Operation of the cartridge firing mechanism may include cocking the cartridge firing mechanism prior to firing a cartridge, the indexing means being adapted to allow the magazine to rotate from the non-aligned position into an aligned position in which a succeeding cartridge chamber is in alignment with the barrel and the firing pin, before the cartridge firing mechanism is fully cocked.

The spring motor may include a helical coil spring.

The indexing means may include first arresting means adapted to arrest rotation of the magazine in the non-aligned position; and second arresting means adapted to arrest rotation of the magazine in the aligned position, such arresting being adapted to take place in use successively for each chamber. The magazine may then include a plurality of circumferentially spaced stops, each stop being associated with a cartridge chamber and being adapted to co-act with the first and second arresting means successively to arrest and to release the magazine such that the cartridge chamber associated with the stop co-acting with the first and second arresting means, is successively in its non-aligned and then in its aligned position. Correspondingly, the indexing means may include circumferentially spaced first and second arresting faces respectively provided on the first and second arresting means, the stop for a particular cartridge chamber being arranged to co-act successively with each arresting face to arrest the magazine successively in the non-aligned and in the aligned positions.

Furthermore, the stops may be retractable and may be biassed axially to provide interference with the arresting faces to arrest the first arresting means including a slide bar slidably mounted in the frame and having the first arresting face, the slide bar being interconnected with the trigger such that, in use, upon depression of the trigger to cock the cartridge firing mechanism, the first arresting face is withdrawn from engagement with a stop before full cocking of the cartridge firing mechanism takes place, thereby permitting automatic displacement of the magazine until arrested by the stop's abutting against the second arresting face, the cartridge chamber being then in its aligned position.

The slide bar may return automatically to its initial position under the bias of the cartridge firing mechanism after operation of the cartridge firing mechanism, thus displacing the stop against its bias out of engagement with the second arresting face, thereby permitting the magazine to rotate until the stop of the next chamber engages with the first arresting face. The second arresting means may include a shoulder fast with the frame, the shoulder having the second arresting face.

The fire arm may be adapted to fire shot cartridges.

In accordance with another aspect of the invention, there is provided a fire arm comprising a frame;

a barrel leading from the frame;

a cartridge firing mechanism biassed to an uncocked position and including a trigger and firing pin, the mechanism being operatively mounted in the frame and adapted to be operated to fire a cartridge;

a rotary magazine having a plurality of circumferentially spaced cartridge chambers and being rotatable relative to the frame discretely to align the chambers with the barrel and the firing pin; and a coil spring which is adapted, in use, to exert torque on the magazine relative to the frame, thereby to rotate the magazine, the magazine defining a cavity of annular cross-section around its rotational axis to accommodate the coil spring, the radial thickness of the cavity being limited to prevent over-winding and excessive unwinding of the coil spring.

The magazine may be mounted on a spindle for rotation relative to the frame of the fire arm, the magazine comprising a casing arranged around the spindle such that the annular cavity is defined between the spindle and the casing.

Instead, when the magazine is mounted on a spindle for rotation relative to the frame of the fire arm, the magazine may comprise a sleeve around the spindle and a casing around the sleeve, the annular cavity being defined between the sleeve and the casing.

In accordance with yet another aspect of the invention, there is provided a fire arm comprising a frame;

a barrel leading from the frame;

a cartridge firing mechanism biassed to an uncocked position and including a trigger and a firing pin, the mechanism being operatively mounted on the frame and adapted to be operated to fire a cartridge;

a rotary magazine having a plurality of circumferentially spaced cartridge chambers and being rotatable relative to the frame discretely to align the chamber with the barrel and the firing pin;

a spring motor which is adapted, in use, to exert torque on the magazine relative to the frame, thereby to rotate the magazine;

a back cover plate disposed closely adjacent the back of the magazine and having a loading opening disposed to be in radial alignment with the rotary path of the cartridge chambers; and indexing means adapted, in use, to arrest the magazine when a cartridge chamber is aligned with the loading opening to facilitate loading of said aligned chamber.

The indexing means may operatively be connected to the cartridge firing mechanism to be operated on depression of the trigger. Such operative connection between the indexing means and the cartridge firing mechanism may be such that partial depression and subsequent release of the trigger will cause the magazine to be released from a position in which one chamber is aligned with the loading opening and will allow it to be rotated by the spring motor and then arrested in a position in which another chamber is aligned with the loading opening. The fire arm may then comprise a safety mechanism which, when set in a loading position, will allow such partial depression of the trigger to operate the indexing means, and will prevent full depression of the trigger thus preventing full cocking of the firing mechanism.

Conveniently, the indexing means may be adapted when the trigger is released, to release the magazine and to allow it to be rotated and then to arrest it in a loading position in which the load opening and a chamber are aligned, and no chamber is aligned with the firing mechanism or the barrel; and when the trigger is partially depressed, to release the magazine from its loading position to allow it to be rotated and to be arrested in a firing position in which a chamber is aligned with the barrel and no chamber is aligned with the load opening.

BRIEF DESCRIPTION OF THE DRAWINGS

The invention is now described by way of example with reference to the accompanying diagrammatic drawings. In the drawings

DETAILED DESCRIPTION OF PREFERRED EMBODIMENT

Figure 1:
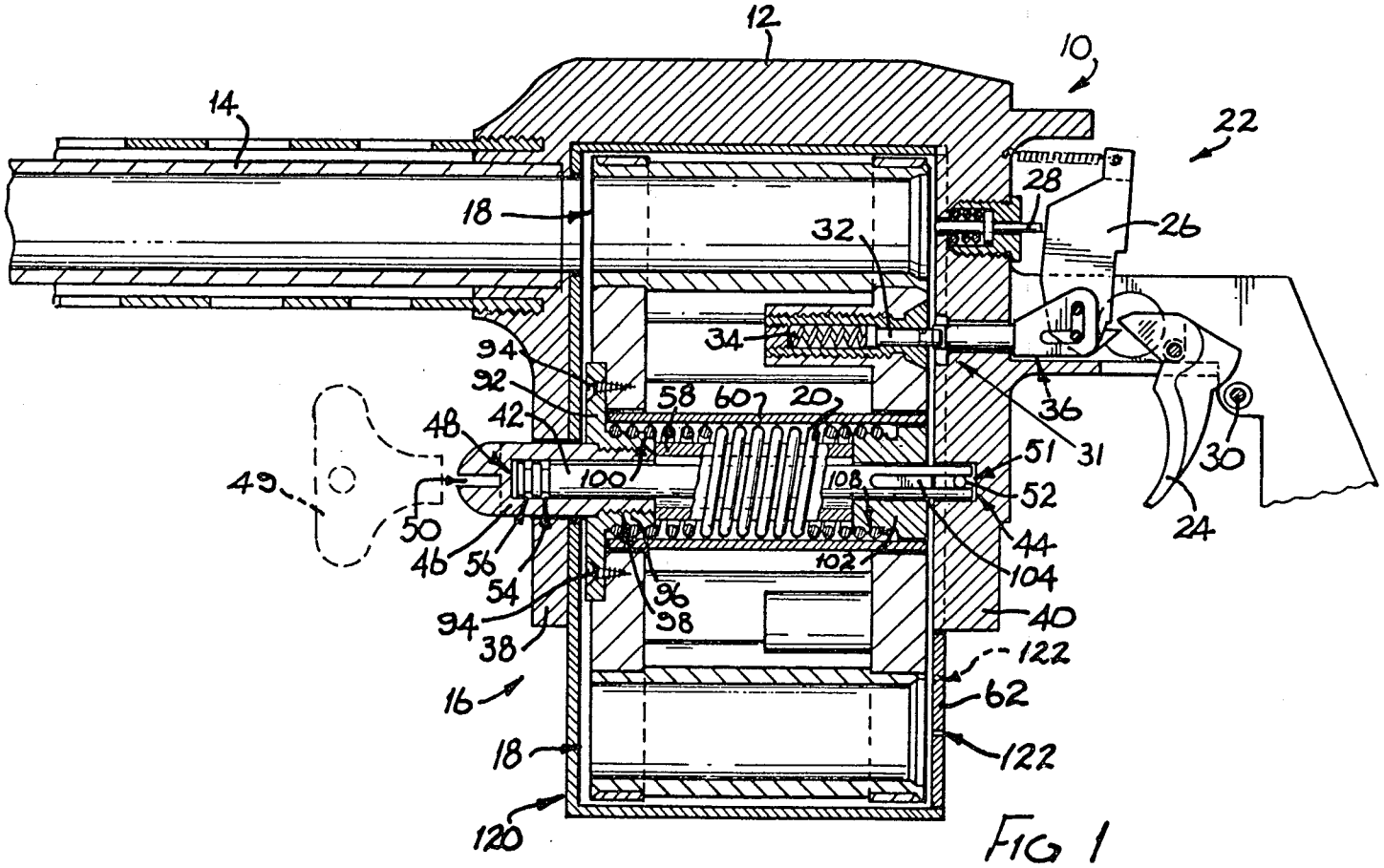
FIG. 1 shows, fragmentarily, a sectional side elevation of a firearm in accordance with the invention.
Figure 2:
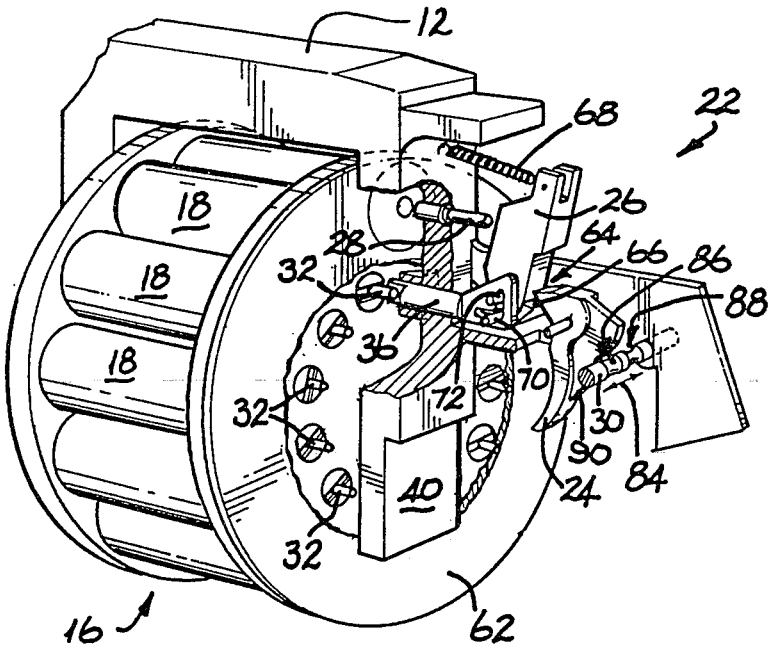
FIG. 2 shows, fragmentarily, in oblique rear view the firing mechanism and magazine of the firearm of FIG. 1.

With reference to FIG. 1 of the drawings, a firearm in accordance with the invention is generally indicated by reference numeral 10. The firearm 10 comprises a frame 12, a barrel 14 leading from the frame 12, a cartridge firing mechanism 22, a rotary magazine 16 mounted in a cavity in the frame 12, a spring motor in the form of a helical coil spring 20, and indexing means 31.

The magazine 16 has a plurality of circumferentially spaced cartridge chambers 18 which are equidistantly spaced from the rotary axis of the magazine. The magazine 16 is rotatable by means of the spring 20 discretely to bring the chambers 18 into alignment with the barrel 14 and a firing pin 28 of the firing mechanism 22.

The firing mechanism 22, which is mounted in the frame 12, comprises a trigger 24 operable to cock and thereafter to release a hammer 26, which then impinges upon the firing pin 28 adapted to strike a detonator of a cartridge to fire it. The firing mechanism also comprises a safety mechanism 30 which will be described in more detail hereinafter.

The magazine 16 comprises a plurality of stops in the form of stop pins 32 forming part of the indexing means 31. There is one stop pin 32 associated with each chamber 18. Each stop pin 32 is spring biassed by means of a spring 34 such that it normally stands proud of the rear face of the magazine 16. The stop pins 32 are retractable and can be pushed forwardly into their housings by means of a slide bar 36 of the firing mechanism 22. This aspect will be described in more detail hereinafter.

The frame 12 has longitudinally spaced downwardly extending front and rear limbs 38 and 40 defining between them a cavity adapted to receive the magazine 16. A forwardly facing socket 44 is defined in the rear limb 40. A cap 46 having a socket 48 is removably screwed into the magazine 16 such that the socket 48 faces and is longitudinally aligned with the socket 44. The cap 46 is received in a passage through the front limb 38. A spindle 42 defining the rotary axis of the magazine 16 is received and held captive within the opposed sockets 44 and 48. The spindle 42 has a diametrical slot 51 in its rear end to co-operate with a key 52 fixed to the limb 40 and disposed within the socket 44 to prevent rotation of the spindle 42 relative to the frame 12. The opposite end, that is the front end of the spindle 42, has two longitudinally spaced peripheral grooves 54 and 56. When the spindle 42 is fully received within the socket 44 the groove 54 is behind the front face of the front limb 38 to indicate that the spindle has been fully received within the socket 44. The groove 56 is adapted to facilitate prising of the spindle 42 from the socket 44 when it is to be removed.

The cap 46 has a diametrical groove 50 at its front end adapted to co-operate with the key 49 to turn the cap 46 and thus also the magazine to which it is attached to wind the spring 20. The spring 20 is fast with the spindle 42 at its rear end, (i.e. it is fixed relative to the frame 12) and fast with the magazine 16 at its front end. Thus, when the spring 20 is wound it will exert torque on the magazine 16 relative to the frame 12.

More specifically, at the front end of the magazine 16 there is provided a flanged bush 92 which is attached to the magazine by means of screws 94. The cylindrical part 96 of the bush 92 has a female screw thread 98 in which the one end of the cap 46 is screwed, and also a male screw thread 100 on which the coils of the spring 20 are screwed.

At the rear of the magazine 16, there is provided a bush 102 around the spindle 42. The spindle 42 has two diametrically opposed longitudinal grooves 104 running out of the slot 51. The busch 102 is rotationally fixed to the spindle by means of two radially disposed grub screws (not shown) engaging the grooves 104. The grub screws can slide along the grooves 104. The bush 102 further has a male screw thread 108 on which the coils at the rear of the spring 20 are screwed.

A round cylindrical sleeve 58 is concentrically received around the spindle 42. A round cylindrical casing 60 is provided concentrically around the spindle 42 and the sleeve 58 so as to form a cavity of annular cross-section between the outer surface of the sleeve 58 and the inner surface of the casing 60. The spring 20 is received within this cavity. The spring 20 can be wound only until its coils abut the outer surface of the sleeve 58, thus preventing overwinding. Similarly, the spring 20 can unwind only until its coils abut the inner surface of the casing 60 thus preventing over-unwinding of the spring 20.

To remove the magazine 16 from the frame 12, the cap 46 is unscrewed from the magazine 16. The spindle 42 can then be withdrawn from the socket 44 which allows the magazine 16 to be removed from the cavity between the limbs 38 and 40.

The magazine 16 is enclosed by means of a magazine cover 120 fast with the frame 12 to prevent ingress of dirt and other unwanted material. The cover 120 has a back cover plate 62 disposed closely adjacent the rear of the magazine 16. The back cover plate 62 prevents cartridges from falling out of the chambers 18. It also has small apertures 122 radially aligned with the chambers 18 such that it is visually noticeable through an aperture, whether or not a cartridge in the corresponding chamber has been detonated.

With reference to FIGS. 2, 3, 4, 7 and 8, the firing mechanism 22 and the rotary advance of the magazine 16 in conjunction with the operation of the firing mechanism 22 is now described in more detail.

The hammer 26 is pivotally mounted about a pivot pin 70. The hammer 26 comprises a hammer body 112 and a pawl 110 which is independently pivotally mounted also about the pivot pin 70. The pawl 110 is accommodated partly in a recess in the hammer body 112 and it has a free end having a shoulder 66 extending beyond the mouth of the recess. The pawl 110 is spring-biassed by means of a spring 114 acting in compression between the hammer body 112 and the pawl 110, to abut a floor of the recess, thereby to limit independent pivotal motion of the pawl relative to the hammer body in one direction.

The trigger 24 has a sear 64 co-operating with the shoulder 66 of the hammer 26 to pivot the hammer 26 rearwardly about the pivot pin 70 during depression of the trigger 24. Such rearward pivotting of the hammer 26 extends a spring 68 provided between the frame 12 and the hammer 26. Further depression of the trigger 24 after the firing mechanism has been cocked, will disengage the sear 64 from the shoulder 66, thus allowing the hammer 26 to shoot forwardly under the tension of the spring 68 to impinge upon the firing pin 28 thereby to fire a cartridge.

When the trigger 24 is released, the sear 64 urges the pawl 110 out of the way against its spring bias so that the sear can move past the free end of the pawl. This enables the sear 64 to co-operate with the shoulder 66 from above when a succeeding cartridge is to be fired.

The hammer 26 also has a transverse pin 72 parallel to and spaced from the pin 70. The pin 72 is received within a groove at the back of the arresting member 36. The arresting member 36 is movable forwardly and rearwardly relative to the frame 12. Pivoting of the hammer 26 during cocking of the firing mechanism 22 causes the pin 72 to urge the arresting member 36 rearwardly. When the hammer 28 shoots forwardly under the spring tension of spring 68, the pin 72 urges the arresting member 36 forwardly.

Figure 3:
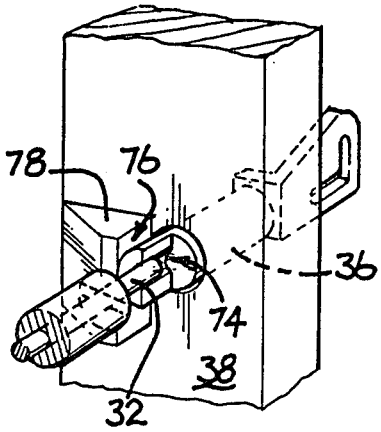
FIG. 3 shows, to a larger scale, in oblique front view an arresting member of the firing mechanism of the firearm of FIG. 1.
Figure 4:
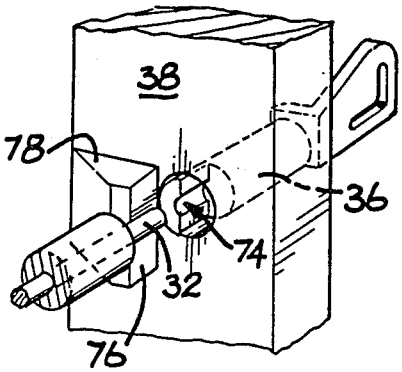
FIG. 4 shows a view similar to that of FIG. 3 but with the arresting member in another position.

Refer now specifically also to FIGS. 3 and 4. With the trigger 24 in its released position, the slide bar 36, which provides first arresting means in accordance with the invention, is in its forward position and a stop pin 32 abuts a first arresting face 74 at the front of the slide bar 36 as shown in FIG. 3. In this position, a cartridge chamber 18 is arrested in a position in which it is not aligned with the firing pin 28 or the barrel 14. This non-aligned position is the position in which the fire arm will be between shots. Because the firing pin 28 is not aligned with a detonator of any cartridge, it cannot unintentionally, such as when the fire arm falls, impinge upon a cartridge to fire it.

Depression of the trigger 24 moves the hammer 26 and also the arresting member 36 backwardly. When the trigger 24 is partially depressed to a certain degree, but the firing mechanism 32 is not yet fully cocked, the arresting face 74 slides from underneath the stop pin 32, thus allowing the stop pin and also the magazine to advance until the stop pin 32 is arrested on a second, stationary, arresting face 76 provided on second arresting means in the form of a shoulder 78 fast with the rear limb 38. In this position, the cartridge chamber 18 associated with the stop pin 32 arrested on the face 76 is aligned with the barrel 14 and also with the firing pin 28. Further depression of the trigger will effect full cocking of the firing mechanism and will cause the cartridge to be fired. Lagging in time behind the motion of the firing pin 28, the arresting member 36 moves forwardly with the hammber 26 and pushes the stop pin 32 against its spring bias into its cavity, thus allowing it to disengage from the arresting face 76, and to slide past the front of the shoulder 78. The arresting member 36 will then be in the position as it is shown in FIG. 3. Simultaneously, the magazine 16 advances until the succeeding stop pin is arrested on the face 74 of the arresting member 36, as shown in FIG. 3.

The magazine 16 is advanced in two stages between shots, namely a first advance stage from an aligned position in respect of one chamber to a non-aligned position in respect of a succeeding chamber, and a second advance stage from said non-aligned position to an aligned position in respect of said succeeding chamber. The travel of the magazine during the first advance stage constitutes the major portion of the total travel of the magazine between adjacent chambers. Thus, the magazine, during the second advance stage, travels through a relatively small angle only. The momentum developed by the magazine during such second advance stage is correspondingly small as is the jerk effected on the frame 12 when the magazine is arrested in an aligned position immediately prior to firing.

It is thus an advantage of the fire arm as illustrated that, between shots, it is an inherently safe condition in as much as the firing pin cannot unintentionally detonate a cartridge. It is a further advantage that rotation of even a large or heavy magazine to, and arresting thereof in, an aligned position immediately prior to firing, will cause relatively little jerking of the fire arm in the hands of the user.

Figure 5:
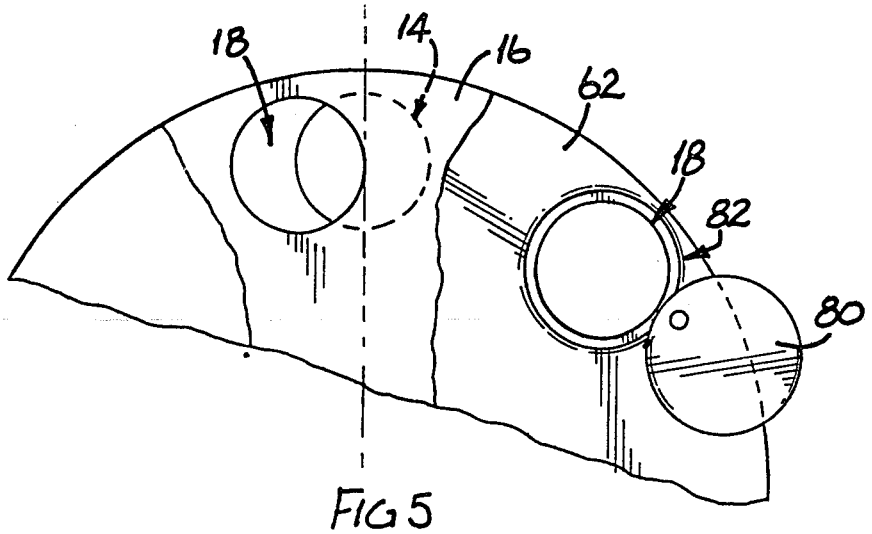
FIG. 5 shows a back cover of the firearm of FIG. 1 and its relation to the magazine chambers and the barrel of the firearm of FIG. 1, in the loading position.
Figure 6:
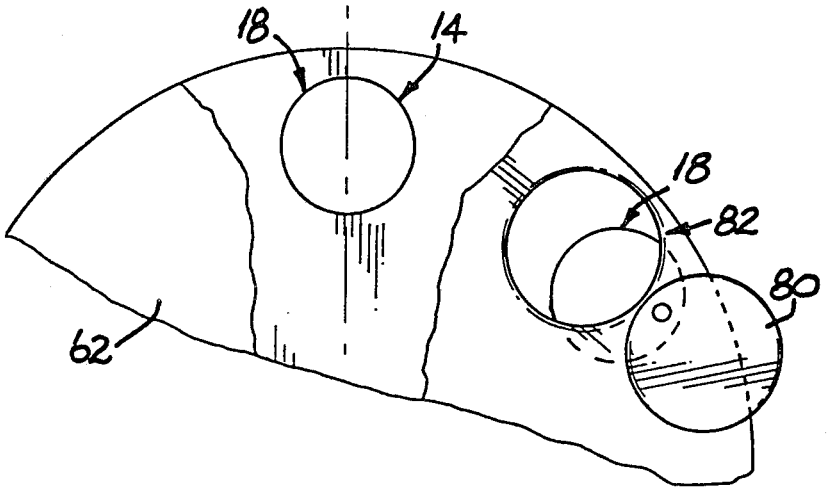
FIG. 6 shows a view similar to that of FIG. 5 but in the firing position.

With reference now also to FIGS. 5 and 6 of the drawings, FIG. 5 shows the position corresponding to FIG. 3 and FIG. 6 shows the position corresponding to FIG. 4.

The back cover 62 has a load opening 82 closable by means of a cover 80 which can be pivoted to render the load opening 82 open or closed. The load opening 82 is positioned such that it is aligned with a cartridge chamber 18 when a preceding cartridge chamber 18 is in a position short of being aligned with the barrel 14 and the firing pin 28. This position is shown in FIG. 5. This is the position corresponding to the position of the stop pin 32 and the arresting member 36 as shown in FIG. 3. The position of the magazine as shown in FIG. 5 will hereinafter be referred to as the loading position. In the loading position, a cartridge can be loaded into a chamber 18 which is aligned with the load opening 82.

When a chamber 18 is aligned with the barrel 14, as shown in FIG. 6, acorresponding chamber 18 is past the position in which it is aligned with the loading opening 82. This position of the magazine 16 will hereinafter be referred to as the firing position. The firing position corresponds to the position of the stop pin 32 and the arresting member 36 as shown in FIG. 4.

Figure 7:
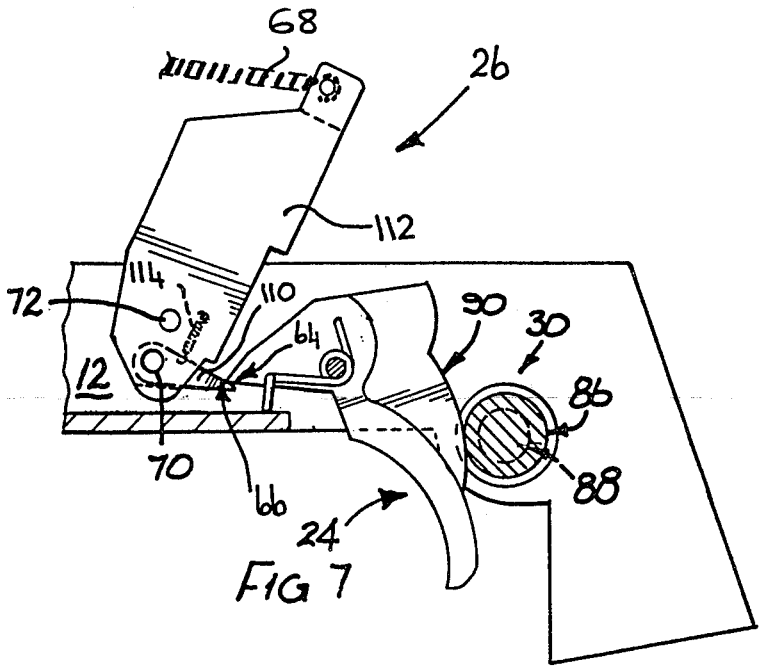
FIG. 7 shows a side view of the firing mechanism and the safety mechanism in the loading position.
Figure 8:
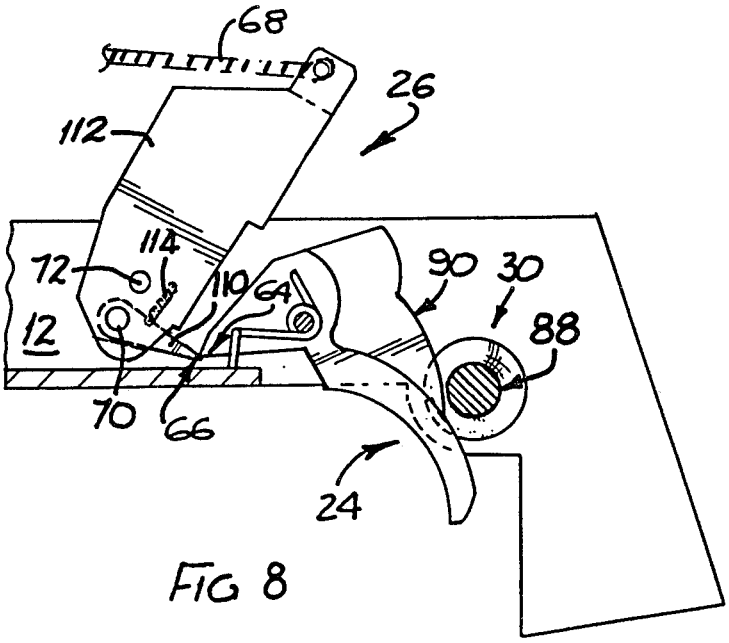
FIG. 8 shows a view similar to that of FIG. 7 but with the safety mechanism in its firing position.

Refer now also to FIGS. 7 and 8 of the drawings.

The safety mechanism 30 comprises a transversely disposed round bar having peripheral grooves 86 and 88 of different depths and disposed alongside each other. The safety mechanism 30 can be moved transversely as shown by arrow 84 in FIG. 2 to positions in which either groove 86 or groove 88 is in alignment with a projection 90 at the rear of the trigger 24. When the deeper groove 88 is aligned with the projection 90, as shown in FIG. 8, the trigger 24 can be depressed fully, thereby to cock fully the firing mechanism 22, to allow firing of the firearm 10. However, when the shallower groove 86 is aligned with the projection 90, it allows only partial depression of the trigger 24 thus preventing full cocking of the firing mechanism 22. In this position, referred to as the loading position of the firing mechanism 30, the trigger 24 is allowed to be depressed sufficiently for the slide bar 36 to slide from underneath a stop pin 32 to allow the stop pin to move onto the face 76 as shown in FIG. 4. It will however not allow the sear 64 to disengage from the shoulder 66 to activate the firing pin 28. Subsequent release of the trigger 24 moves the slide bar 36 forwardly to push the stop pin 32 off the arresting face 76 and to allow a succeeding stop pin 32 to move onto the arresting face 74 as shown in FIG. 3. The position as shown in FIG. 7 corresponds to the positions as shown in FIGS. 4 and 6. However, it must be understood that although the position corresponding to FIG. 7 has a cartridge chamber 18 aligned with the barrel 14 and the firing pin 28, it is not a true firing position as the firing mechanism cannot be fully cocked to allow firing with the safety mechanism 30 in its loading position.

The loading of the firearm 10 is now described in more detail with reference to FIGS. 3 to 7 inclusive.

Assume the starting position to be as shown in FIGS. 3 and 5. The shallower groove 86 of the safety mechanism 30 is aligned with the projection 90. A cartridge can be loaded into the cartridge chamber 18 in alignment with the load opening 82.

The trigger 24 is depressed until the position as shown in FIG. 7 corresponding to FIGS. 4 and 6 is reached. Release of the trigger 24 will bring about the position as shown in FIGS. 3 and 5, but with a succeeding stop pin 32 arrested on the arresting face 74, and a succeeding chamber 18 in alignment with the load opening 82. Said succeeding cartridge chamber 18 is loaded. The above procedure is repeated until the magazine 16 is fully loaded. The magazine is advanced by means of the torque exerted by the wound spring 20 on the magazine relative to the frame 12.

An ejecting mechanism, which is not shown in the drawings, is provided. The ejecting mechanism is adapted to eject cartridges or cartridge jackets from a cartridge chamber 18 when it is in a position aligned with the load opening 82. Thus, unloading of the magazine 16 can be performed in a manner similar to the manner of loading. Alternatively, loading and unloading can take place simultaneously by first ejecting a spent cartridge jacket from a chamber 18 and immediately loading a fresh cartridge into the same chamber 18 before advancing the magazine.

With reference now to FIG. 8, to fire the firearm 10, the safety mechanism 30 is set such that the deeper groove 88 is aligned with the projection 90. This allows the trigger 24 to be depressed fully thereby, firstly to cock fully the firing mechanism and thereafter to cause the sear 64 to disengage from the shoulder 66 to fire the firearm 10.

It is to be understood that, in all the above operations, the magazine is advanced by rotation by means of the spring 20. The spring 20 is wound by means of the key 49 from time to time.

I claim:

1. A fire arm comprising a frame;

a barrel leading from the frame;

a cartridge firing mechanism biassed to an uncocked position and including a trigger and firing pin, the mechanism being operatively mounted in the frame and adapted to be operated to fire a cartridge;

a rotary magazine having a plurality of circumferentially spaced cartridge chambers and being rotatable relative to the frame discretely to align the chambers with the barrel and the firing pin;

a spring motor which is adapted, in use, to exert torque on the magazine relative to the frame, thereby to rotate the magazine; and indexing means adapted to operate automatically after operation of the cartridge firing mechanism to allow the magazine to rotate from an aligned position in which a cartridge chamber is in alignment with the barrel and the firing pin, and to arrest the magazine in a non-aligned position in which no cartridge chamber is in alignment with the barrel and the firing pin.

2. A fire arm as claimed in claim 1, in which operation of the cartridge firing mechanism includes cocking the cartridge firing mechanism prior to firing a cartridge, and in which the indexing means is adapted to allow the magazine to rotate from the non-aligned position into an aligned position in which a succeeding cartridge chamber is in alignment with the barrel and the firing pin, before the cartridge firing mechanism is fully cocked.

3. A fire arm as claimed in claim 1, in which the spring motor includes a helical coil spring.

4. A first arm as claimed in claim 1, in which the indexing means includes first arresting means adapted to arrest rotation of the magazine in the non-aligned position; and second arresting means adapted to arrest rotation of the magazine in the aligned position, such arresting being adapted to take place in use successively for each chamber.

5. A fire arm as claimed in claim 4, in which the magazine includes a plurality of circumferentially spaced stops, each stop being associated with a cartridge chamber and being adapted to co-act with the first and second arresting means successively to arrest and to release the magazine such that the cartridge chamber associated with the stop co-acting with the first and second arresting means, is successively in its non-aligned and then in its aligned position.

6. A fire arm as claimed in claim 5, in which the indexing means includes circumferentially spaced first and second arresting faces respectively provided on the first and second arresting means, the stop for a particular cartridge chamber being arranged to co-act successively with each arresting face to arrest the magazine successively in the non-aligned and in the aligned positions.

7. A fire arm as claimed in claim 6, in which the stops are retractable and are biassed axially to provide interference with the arresting faces to arrest the first arreasting means including a slide bar slidably mounted in the frame and having the first arresting face, the slide bar being interconnected with the trigger such that, in use, upon depression of the trigger to cock the cartridge firing mechanism, the first arresting face is withdrawn from engagement with a stop before full cocking of the cartridge firing mechanism takes place, thereby permitting automatic displacement of the magazine until arrested by the stop's abutting against the second arresting face, the cartridge chamber being then in its aligned position.

8. A fire arm as claimed in claim 7, in which, after operation of the cartridge firing mechanism, the slide bar returns automatically to its initial position under the bias of the cartridge firing mechanism and displaces the stop against its bias out of engagement with the second arresting face, thereby permitting the magazine to rotate until the stop of the next chamber engages with the first arresting face.

9. A fire arm as claimed in claim 8, in which the second arresting means includes a shoulder fast with the frame, the shoulder having the second arresting face.

10. A fire arm as claimed in claim 1, which is adapted to fire shot cartridges.

11. A fire arm comprising a frame;

a barrel leading from the frame;

a cartridge firing mechanism biassed to an uncocked position and including a trigger and a firing pin, the mechanism being operatively mounted on the frame and adapted to be operated to fire a cartridge;

a rotary magazine having a plurality of circumferentially spaced cartridge chambers and being rotatable relative to the frame discretely to align the chamber with the barrel and the firing pin;

a spring motor which is adapted, in use, to exert torque on the magazine relative to the frame, thereby to rotate the magazine;

a back cover plate disposed closely adjacent the back of the magazine and having a loading opening disposed to be in radial alignment with the rotary path of the cartridge chambers; and indexing means adapted, in use, to arrest the magazine when a cartridge chamber is aligned with the loading opening to facilitate loading of said aligned chamber.

12. A fire arm as claimed in claim 11, in which the indexing means is operatively connected to the cartridge firing mechanism to be operated on depression of the trigger.

13. A fire arm as claimed in claim 12, in which the operative connection between the indexing means and the cartridge firing mechanism is such that partial depression and subsequent release of the trigger will cause the magazine to be released from a position in which one chamber is aligned with the loading opening and will allow it to be rotated by the spring motor and then arrested in a position in which another chamber is aligned with the loading opening.

14. A fire arm as claimed in claim 13, which comprises a safety mechanism which, when set in a loading position, will allow such partial depression of the trigger to operate the indexing means, and will prevent full depression of the trigger thus preventing full cocking of the firing mechanism.

15. A fire arm as claimed in claim 13 or claim 14, in which the indexing means is adapted when the trigger is released, to release the magazine and to allow it to be rotated and then to arrest it in a loading position in which the load opening and a chamber are aligned, and no chamber is aligned with the firing mechanism or the barrel; and when the trigger is partially depressed, to release the magazine from its loading position to allow it to be rotated and to be arrested in a firing position in which a chamber is aligned with the barrel and no chamber is aligned with the load opening.

16. A firearm comprising a frame;

a barrel leading from the frame;

a cartridge firing mechanism biased to an uncocked position and including a trigger and firing pin, the mechanism being operatively mounted in the frame and adapted to be operated to fire a cartridge;

a rotary magazine having a plurality of circumferentially spaced cartridge chambers and being mounted on a spindle for rotation relative to the frame discretely to align the chambers with the barrel and the firing pin; and a coil spring which is adapted, in use, to exert torque on the magazine relative to the frame, thereby to rotate the magazine, the magazine comprising a sleeve around the spindle and a casing around the sleeve defining therebetween a cavity of annular cross-section around its rotational axis to accommodate the coil spring, the radial thickness of the cavity being limited to prevent over-winding and excessive unwinding of the coil spring.

* * * * *